United States Patent [19]

Takahashi

[11] 4,408,691

[45] Oct. 11, 1983

[54] NEEDLE HOLDER

[75] Inventor: Masamitsu Takahashi, Hiroshima, Japan

[73] Assignee: Bankoku Needle Manufacturing Co., Ltd., Hiroshima, Japan

[21] Appl. No.: 388,523

[22] Filed: Jun. 15, 1982

[51] Int. Cl.[3] ..... B65D 85/24

[52] U.S. Cl. ..... 206/382; 206/45.13; 206/471

[58] Field of Search ..... 206/45.13, 329, 331, 206/365, 366, 371, 379, 381, 382, 383, 380, 470, 471, 482

[56] References Cited

U.S. PATENT DOCUMENTS

| | | | |
|---|---|---|---|
| 121,860 | 12/1871 | Evans | 206/382 |
| 1,927,415 | 9/1933 | Petherbridge et al. | 206/470 |
| 3,236,366 | 2/1966 | Broda | 206/379 |
| 3,444,995 | 5/1969 | Sanders | 206/382 |
| 3,500,998 | 6/1969 | Sanders | 206/382 |
| 3,651,935 | 3/1972 | Nysten | 206/380 |
| 3,951,263 | 4/1976 | Vale | 206/382 |
| 4,210,239 | 7/1980 | Takahashi | 206/382 |
| 4,243,141 | 1/1981 | Takahashi | 206/380 |

FOREIGN PATENT DOCUMENTS

| | | | |
|---|---|---|---|
| 2250208 | 4/1974 | Fed. Rep. of Germany | 206/371 |
| 512926 | 9/1939 | United Kingdom | 206/382 |
| 1081927 | 9/1967 | United Kingdom | 206/470 |
| 1169244 | 10/1969 | United Kingdom . | |

*Primary Examiner*—George E. Lowrance
*Assistant Examiner*—Jimmy G. Foster
*Attorney, Agent, or Firm*—Kenway & Jenney

[57] ABSTRACT

A needle holder is disclosed which includes a base member having a centrally located U-shaped cut defining a tongue-shaped member and fold lines perpendicular to the longitudinal axis of the package and extending from the U-shaped cut to the longitudinal edges. A fold line in the tongue-shaped member parallel to the aforementioned fold lines serves to divide the tongue-shaped member into distal and fixed portions. A retainer for the needles is attached to the distal portion of the tongue-shaped member and a cover member is secured to one end of the base member, with its opposite end free. The described structure allows the needle package to be opened by bending the package along the pair of fold lines whereby the distal end of the tongue-shaped member is raised and slides between the base member and the cover member to lift the needles carried thereon to a position where the needles will protrude beyond the cover.

7 Claims, 9 Drawing Figures

NEEDLE HOLDER

BACKGROUND OF THE INVENTION

The present invention relates to a package for elongated articles and more particularly to a needle holder enabling easy extracting and returning a desired needle by utilization of a sliding construction of its component parts.

A conventional needle holder includes a sheet cover having a retention portion, and a small retaining piece for a plurality of needles detachably fitted within the retention portion of the sheet cover. With such a needle holder the desired needle is extracted from the small retaining piece by wrapping the sheet cover and then extracting the small retaining piece from the retention portion of the sheet cover.

Since conventional needle holders are generally made of a paper material, repeated extracting and restoring of the small retaining piece relative to the sheet cover may result in deformation of the needle holder. Therefore, it cannot be expected that such a needle holder will have high durability. Such a needle holder has further disadvantages in that it requires the troublesome steps of unwrapping the sheet cover, extracting the small retaining piece from the retention portion of the sheet cover and extracting a desired needle from the small retaining piece. Further, although the sheet cover is generally provided with an inspection window for inspecting the needles retained therein, a user cannot inspect those needles which do not appear in the inspection window and therefore may overlook rust, damage and discoloration of some needles.

SUMMARY OF THE INVENTION

The present invention is directed toward overcoming the shortcomings as described above.

One object of the present invention is to provide a needle holder which is easily opened for access to the needles retained therein by applying a small bending force to the needle holder.

Another object of the present invention is to provide a needle holder which is easily opened in a sliding fashion and which is excellent in durability.

Still another object of the present invention is to provide a needle holder which is easily opened in sliding fashion and which may be manufactured at reduced cost.

A further object of the present invention is to provide a needle holder which may be easily opened in sliding fashion and which permits visual inspection of all needles in the unopened holder.

To achieve the objects described above according to the present invention, there is provided a needle holder which includes a base member having a centrally located U-shaped cut defining a tongue-shaped member and fold lines perpendicular to the longitudinal axis of the package and extending from the U-shaped cut to the longitudinal edges. A fold line in the tongue-shaped member parallel to the aforementioned fold lines serves to divide the tongue-shaped member into distal and fixed portions. A retainer for the needles is attached to the distal portion of the tongue-shaped member and a cover member is secured to one end of the base member, with its opposite end free. The described structure allows the needle package to be opened by bending the package along the pair of fold lines whereby the distal end of the tongue-shaped member is raised and slides between the base member and the cover member to lift the needles carried thereon to a position where the needles will protrude beyond the cover member.

These and other objects and characteristic features of the present invention will become apparent from the further description of the invention which follows with reference to the accompanying drawings.

DETAILED DESCRIPTION OF THE PREFERRED EMBODIMENT

Figure 1:
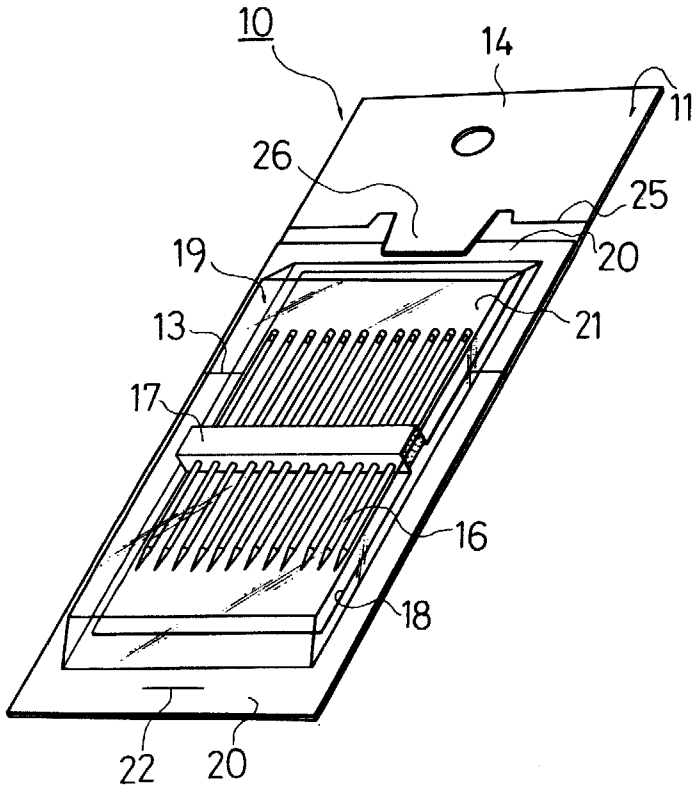
FIG. 1 is a schematic outline view of one preferred embodiment of a needle holder according to the present invention.
Figure 2:
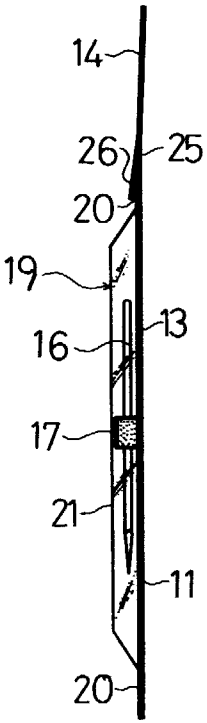
FIG. 2 is a side view of the needle holder of FIG. 1.
Figure 3:
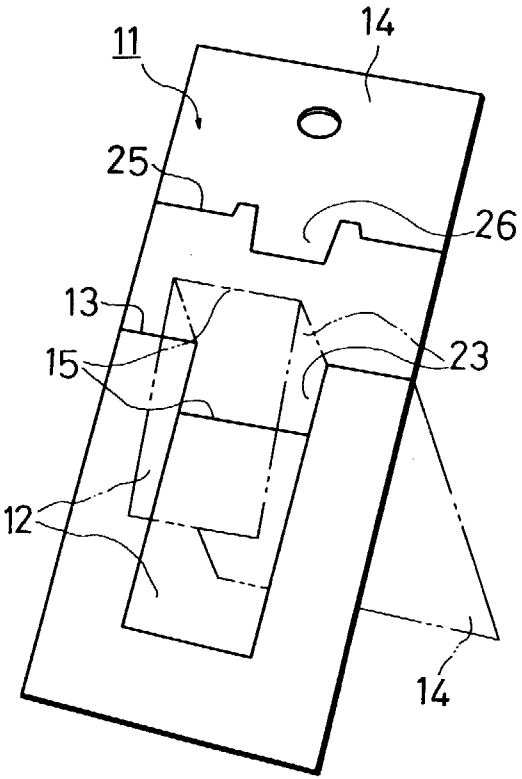
FIG. 3 is a schematic view illustrating the base of the needle holder.

FIG. 1 illustrates one preferred embodiment of a needle holder according to the present invention, denoted by reference numeral 10 and adapted for removal of needles by utilization of a sliding construction of its component parts (hereinafter referred to as a "sliding-type needle holder"). The sliding-type needle holder 10 has, as illustrated in FIG. 3, a flat rectangular base 11 and a fitting portion 12 formed by a substantially U-shaped cut in the base 11 in the vicinity of the central lower portion of the base 11.

Figure 4:
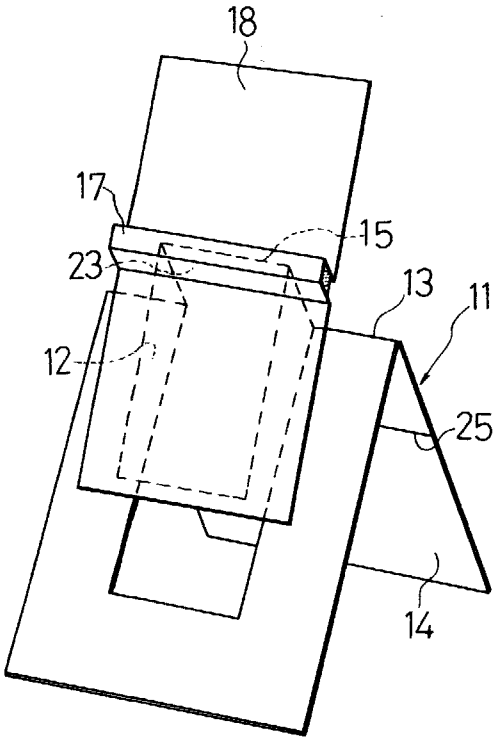
FIG. 4 is a schematic view showing the base having a pincushion member attached.

The fitting portion 12 is tongue-shaped. There are formed a pair of first folds 13 on the substrate 11 extending perpendicularly toward the edges from the top of the U-shaped cut. The portion of the base 11 above the first folds 13 functions as an operating portion 14. The tongue-shaped fitting portion 12 has a second fold 15 formed below and parallel to the first folds 13. The portion of the fitting portion 12 between the first folds 13 and the second fold 15 functions as a moving portion 23 which is integral with and moves in conjunction with the operating portion 14. The fitting portion 12 below the second fold 15 can, therefore, be slidably moved in the longitudinal direction by operating the operating portion 14. The the fitting portion 12 carries a needle retaining member 18 and a pincushion member 17 and made of a foamed synthetic resin for retaining a plurality of needles 16 therein as illustrated in FIG. 4.

Figure 7:
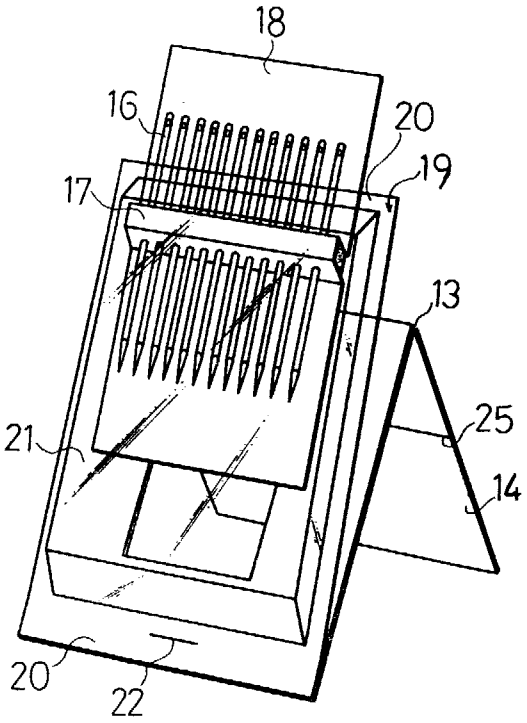
FIG. 7 is a schematic outline view showing the needle holder bent in the shape of a letter "V".
Figure 5:
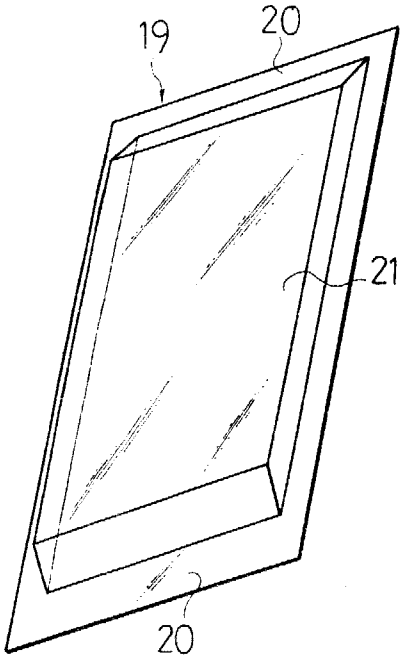
FIG. 5 is a schematic outline view of the cover member of the needle holder.

FIG. 5 shows a transparent cover member 19 to be attached to the lower portion of the base 11 for covering the needle retaining member 18 and pincushion member 17. This cover member 19 is made of a synthetic resin such as polyvinyl chloride, polyamide, polyester or acryl and, insofar as it is transparent, it may either be colored or be colorless. The cover member 19 comprises a concave cover portion 21 and an outer edge portion 20 extending outwardly from the open edge of the concave cover portion 21. The cover member 19 is attached to the base 11 along the area where it mates with the lower horizontal portion of the outer edge portion 20 by fastening means such as a staple so as to cover the upper surface of the needle retaining member 18 of the pincushion member 17 attached to the fitting portion 12 as illustrated in FIG. 7.

A description of use the sliding-type needle holder 10 of the present invention follows.

When the lower portion of the sliding-type needle holder 10 is supported with one hand and then the operating portion 14 is slightly bent rearwardly with the other hand, the operating portion 14 bends at folds 13 and at the same time, the moving portion 23, formed between the first folds 13 and the second fold 15, raises member 12 and the needle retaining member 18 and pincushion member 17 carried by member 12 to ascend in a sliding fashion. Since the lateral sides and the upper side of the cover member 19 are not attached to the base 11, when the needle retaining member 18 is raised in sliding fashion as described above, the needle retaining member 18 will protrude from the upper end of the cover member 19 and becomes accessible. In such an extended, protruding position the needles 16 can easily be extracted from the pincushion member 17. To retain the sliding-type needle holder 10 of the present invention in the aforementioned state, the base 11 and the operating portion 14 may be bent in the form of a letter "V", with the first folds 13 as the fulcrums, as shown in FIG. 7. Since the sliding-type needle holder can thus be retained, a thread (not shown) can easily be passed through the eye of any desired needle 16.

Upon completion of sewing with the needle and thread, the needle 16 is accommodated within the sliding-type needle holder by reinserting the needle in the pincushion member 17 and unbending the base 11 until the operating portion 14 aligns the lower portion of the base 11.

By the aforementioned manual operation, the needle retaining member 18 is moved, from a position where one half protrudes outwardly, downwardly to a position where it is entirely covered by the cover member 19. The inner surface of the cover portion 21 of the cover member 19, when the needle retaining member 18 is either raised or lowered, comes into sliding contact with the pincushion member 17 and functions as a guide member.

Returning to FIG. 1, the operating portion 14 has third folds 25 formed substantially central thereof and a cut formed in the vicinity of the third folds 25 so as to define a tongue-shaped engaging piece 26. The cover 21 of the needle holder 10 is retained in a closed position by placement of member 26 over the upper portion of the outer edge portion 20 of the cover member 19.

Figure 6B:
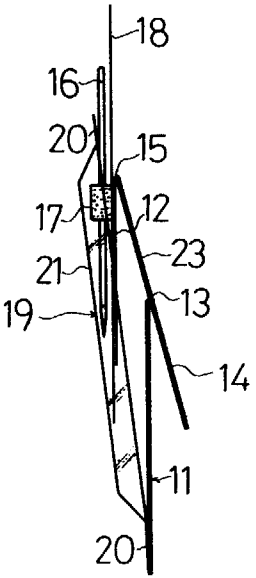
FIGS. 6A and 6B are schematic outline views showing the needle holder positioned for removal of a needle.
Figure 6A:
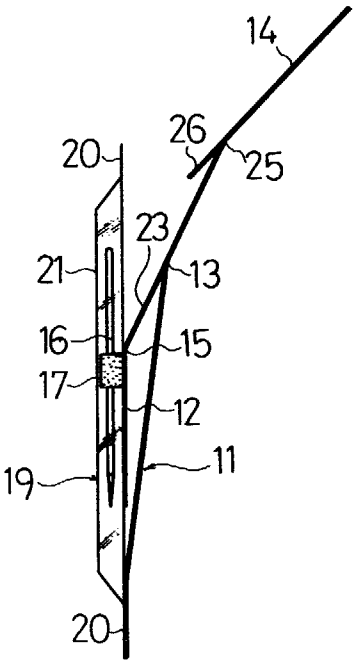
Figure 8:
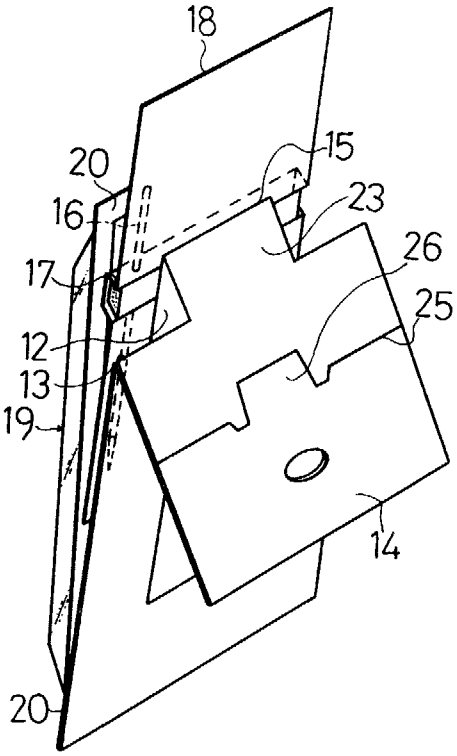
FIG. 8 is a perspective view from the rear side of the needle holder, showing the state wherein the package is bent so that the needles may be extracted.

The sliding-type needle holder according to the present invention has the construction as described above and, therefore, enjoys the following advantages.

a. The needle retaining member and needles may be easily raised in a sliding fashion to the position shown in FIGS. 6B, 7 and 8 where they protrude above the cover member by applying a small bending force to the operating portion constituting the upper end of the needle holder base with one of the hand while supporting the lower end of the needle holder with the other hand. In this manner any desired needle can easily be extracted from the pincushion member.

b. Since it is unnecessary to use a cover of a complicated shape, needle holders can be manufactured expensively.

c. Since the cover member is made of a transparent synthetic resin material, it is possible to inspect the appearance of the needles accommodated within the unopened holder. In other words, any adverse change to the needles such as rust, damage, discoloration, etc. can easily be detected from the outside without opening the needle holder. Therefore, consumers or users can be assured of obtaining and using needles of good quality merely by inspection of the unopened package.

What is claimed is:

1. A package for elongated articles comprising:

(a) a base member having:

(i) a centrally located U-shaped cut defining a tongue-shaped member;

(ii) a pair of fold lines perpendicular to the longitudinal axis of the package and extending from said U-shaped cut to the longitudinal edges of the package; and (iii) a fold line in said tongue-shaped member parallel to said first fold lines and dividing said tongue-shaped member into distal and fixed portions;

(b) retaining means for said elongated articles attached to said distal portion of said tongue-shaped member; and (c) a cover member for covering the elongated articles secured to one end of said base member;

whereby bending of said package along said pair of fold lines causes said distal end of said tongue-shaped member and said elongated articles to slide between said base member and said cover member to a position where the elongated articles will protrude beyond said cover member.

2. The package according to claim 1, wherein said pincushion member is provided with a needle retaining member for retaining thereon said plurality of needles.

3. The package according to claim 1, wherein said pincushion member is made of a foamed synthetic resin.

4. The package according to claim 1, wherein said transparent cover member is made of a synthetic resin.

5. The package according to claim 1, wherein said transparent cover member functions as a guide for allowing said pincushion member to slidably ascend and descend.

6. The package of claim 1 where said U-shaped cut is centered on the longitudinal axis of the needle holder.

7. The package of claim 1 wherein said base member is further provided with a second tongue-shaped member for retaining the free end of said cover member against said base.

* * * * *